United States Patent [19]

Foldes

[11] 4,030,048

[45] June 14, 1977

[54] MULTIMODE COUPLING SYSTEM INCLUDING A FUNNEL-SHAPED MULTIMODE COUPLER

[75] Inventor: Peter Foldes, Wayne, Pa.

[73] Assignee: RCA Corporation, New York, N.Y.

[22] Filed: July 6, 1976

[21] Appl. No.: 702,402

[52] U.S. Cl. ..... 333/6; 333/21 R; 333/21 A; 333/73 W; 343/16 M; 343/786

[51] Int. Cl.[2] ..... H01P 1/16; H01P 5/12

[58] Field of Search ..... 333/21 R, 21 A, 6, 9; 343/786, 852, 16 M, 100 PE

[56] References Cited

UNITED STATES PATENTS

| | | | |
|---|---|---|---|
| 3,696,434 | 10/1972 | Sciambi, Jr. | 333/21 R X |
| 3,936,838 | 2/1976 | Foldes | 343/786 |

*Primary Examiner*—Paul L. Gensler
*Attorney, Agent, or Firm*—Edward J. Norton; Robert L. Troike; Leonard Weiss

[57] ABSTRACT

A multimode coupling system for coupling symmetrical waveguide mode signals and two or more tracking asymmetrical waveguide mode signals includes a funnel-shaped coupler with a plurality of coupling apertures located in the side wall thereof. A first four of these side wall apertures lie in a first common plane at a given distance from the small aperture end of the coupler. A second four of these apertures lie in a second common plane a second given distance from the small aperture end of the coupler. A first coupling circuit is provided between the first group of side wall apertures and an asymmetrical mode terminal, and a second coupling circuit is provided between the second four apertures in the second plane and a second asymmetrical mode terminal. Each coupling circuit includes a separate filter for each aperture, with the filters coupled to the first four side wall apertures adapted to pass signals at a first frequency band and with the filters coupled to the second four side wall apertures adapted to pass signals at a second frequency band.

8 Claims, 7 Drawing Figures

MULTIMODE COUPLING SYSTEM INCLUDING A FUNNEL-SHAPED MULTIMODE COUPLER

BACKGROUND OF THE INVENTION

This invention relates to a microwave coupling system and, more particularly, to a system by which a symmetrical mode can be excited or received and two orthogonal asymmetrical modes at two frequency bands can be excited or received.

Antenna feed systems capable of generating and receiving microwave power in a plurality of modes have been developed and are known as multimode feed systems. Such multimode feed systems are often used in monopulse tracking antennas wherein the energy transmitted and received by the feed systems is combined in such a manner that sum (symmetrical) and difference (asymmetrical) mode radiation patterns are produced during transmission and/or reception. These patterns are analyzed to determine the position of a passive (reflecting) or active (radiating) object which may be either an aircraft, a missile, or a satellite or celestial body or to provide automatic tracking of these objects. Monopulse tracking systems are discussed for instance in, "Radar Handbook," by Merrill I. Skolnick, published 1970 by McGraw-Hill Book Co. and "Introduction to Monopulse," by D. R. Rhodes, published in 1959 by McGraw-Hill Book Co.

The typical tracking feed system may include several horns or apertures. When only a small number of horns are used, such as in the four-horn antennas, the radiation patterns have undesirable characteristics mainly in the form of high level sidelobes and internal losses which lower the efficiency (tracking slope) and increase the noise temperature of the system. Some prior art single aperture monopulse couplers although operative and possessing improved tracking slope have lower than ideal gain to noise temperature ratio for their sum mode when they are used as feed systems for reflector-type antennas and when operated over a wide range of frequencies. For more details on a single aperture monopulse coupler, see pages 21 - 18 through 21 - 25 in the previously-cited "Radar Handbook."

One type of multimode coupler by which sum and difference modes can be launched into the throat of a single aperture horn is described in applicant's U.S. Pat. No. 3,560,976. It is desirable in certain applications such as in frequency reuse systems that higher gain over noise temperature (loss) ratios and particularly lower cross-polarization levels for the associated sum mode operation be provided. In frequency spectrum reuse applications for communication systems, the same frequency spectrum is reused but is communicated at orthogonal polarizations. In such systems the total information carrying capacity of the system is improved by increasing the isolation between the two approximately orthogonal polarizations. The isolation, of level difference, between the two polarizations is usually maximum in the direction represented by the symmetry axis of the main beam. It is therefore highly desirable to achieve an accurate alignment of the antenna axis toward the other terminal of the link (antenna of a satellite for example) by a high quality orthogonal difference mode to permit tracking. This however has to be done with minimum noise temperature (loss) contribution from the tracking circuit to the communication circuit and by minimum depolarization effect from the tracking circuit itself of the sum channel circuit. Furthermore in spectrum reuse systems, the tracking capability is desirable at one of two orthogonally polarized and different beacon frequencies.

The above problems have been partially overcome by a multimode coupler system including a funnel shaped coupler as described in applicant's U.S. Pat. No. 3,936,838, dated Feb. 3, 1976. Briefly, the system includes a funnel-shaped hollow member with a small aperture end of the funnel-shaped member adapted to pass symmetrical mode signals and the large aperture end adapted to be coupled to free space or to the throat of a horn radiator. Asymmetrical mode coupling is provided to a plurality of side wall coupling apertures in a given plane with these side wall apertures located a given length from the small aperture end of the funnel-shaped member. This given length is made equal to approximately one-half the guide wavelength of the $TE_{21}$ asymmetrical mode or multiple thereof at the desired coupling frequencies. A difficulty occurs if one wishes to operate the system using two or more beacon tracking frequencies where these frequencies are fairly close to each other such that it is difficult to physically separate these side wall coupling apertures or their associated circuitry. Also, it may be desirable to operate the coupler at one of the beacon frequencies in a left circuitry polarized or linearly polarized mode while operating at the other beacon frequency in a right circularly polarized or orthogonally polarized mode or to operate the system in a more broadband mode. The present invention is aimed at solving these problems.

BRIEF DESCRIPTION OF THE INVENTION

Briefly, a multimode coupling system for coupling symmetrical waveguide mode signals at one frequency band and asymmetrical waveguide mode signals in the same mode or in another frequency band is provided. The system includes a generally funnel-shaped hollow coupler with the small aperture end adapted to pass the symmetrical mode signals and reflect the asymmetrical mode signals and the large aperture end adapted to couple the symmetrical and asymmetrical mode signals to free space. Four side wall coupling apertures are located in the sloping wall of the coupling member with a first and second of these apertures at diametrically opposite surfaces of the member and in a given plane a given distance from the small aperture end of the coupler. The third and fourth of the side wall coupling apertures are at diametrically opposite surfaces of the member and are spaced in the same given plane equally spaced from the first and second side wall apertures. An asymmetrical waveguide mode coupling circuit provides in response to signals at an asymmetrical waveguide mode terminal approximately one-fourth of the energy to each of the side wall apertures with the phase of the signal at the first and third of the apertures being advanced 90° relative to the phase of the signals at the second and fourth of these apertures. The coupling circuit includes a filter-polarizer coupled to each of the side wall apertures with the filter-polarizer characterized by a response to signals applied thereto for exciting an elliptically polarized wave of a given axial ratio and orientation of polarization ellipse into the coupling member. For a given side wall aperture to small aperture end distance of the coupler, the axial ratio and polarization ellipse orientation of the elliptically polarized wave coupled into the member by the filter-polarizer are determined to achieve maximum coupling to the desired asymmetrical waveguide mode at a wanted polarization different from the elliptical polarization generated by the filter-polarizer. For instance, if the desired polarization of the wave at the large aperture end of the coupler is circular polarization then a specific elliptical polarization for the wave at the coupler aperture is required.

IN THE DRAWINGS

A more detailed description follows in conjunction with the following drawing wherein:

FIG. 1 shows a side view of a multimode monopulse coupler according to one embodiment of the present invention, FIG. 2 illustrates a cross-sectional view of the multimode monopulse coupler shown in FIG. 1 taken along the lines 2 — 2 and a block diagram of the associated feed circuit, FIG. 3 illustrates a cross-sectional view of the multimode monopulse coupler shown in FIG. 1 taken along the lines 3 — 3 and the simplified block diagram of the associated feed circuit, FIG. 4 illustrates a coupling plate according to one embodiment of the present invention, FIG. 5 illustrates a four section filter-polarizer according to one embodiment of the present invention, FIG. 6 is a cross-sectional view of a filter-polarizer taken across lines 6 — 6 in FIG. 5, and FIG. 7 is an end view of a filter-polarizer taken at lines 7 — 7 in FIG. 5.

DETAILED DESCRIPTION OF INVENTION

Figure 1:
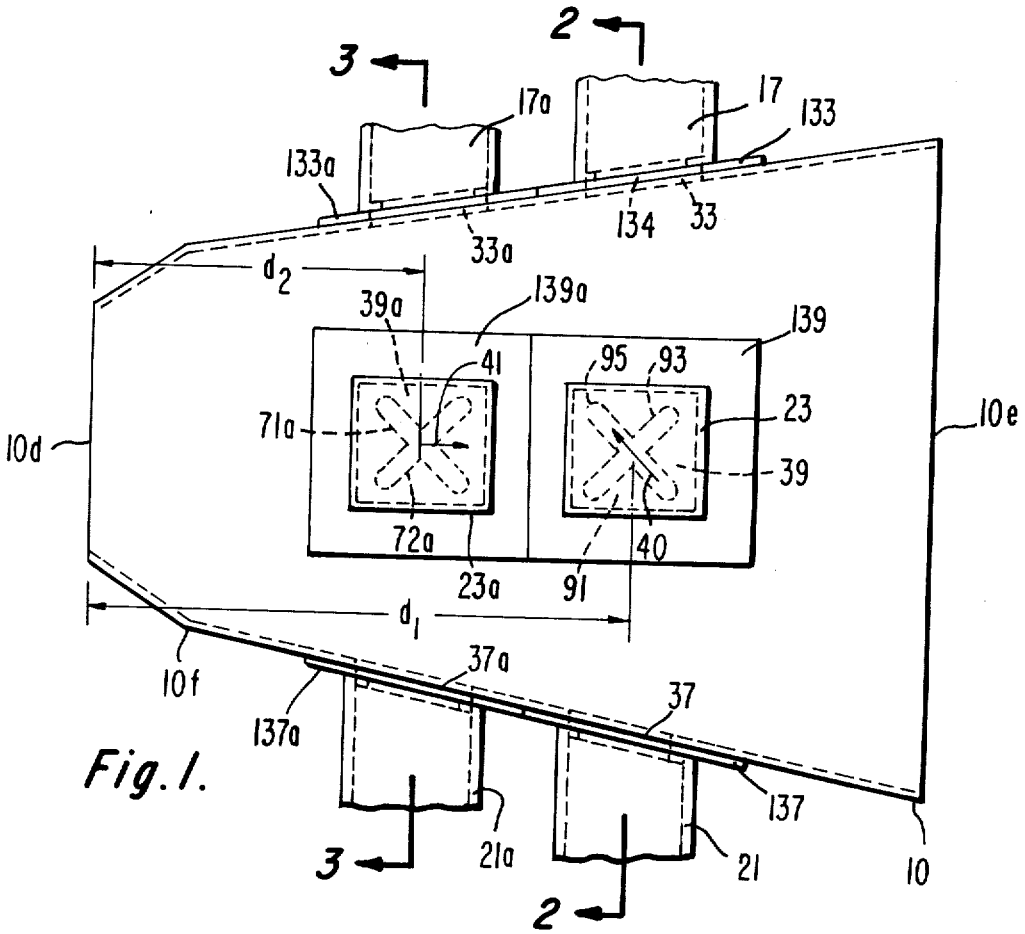
Figure 2:
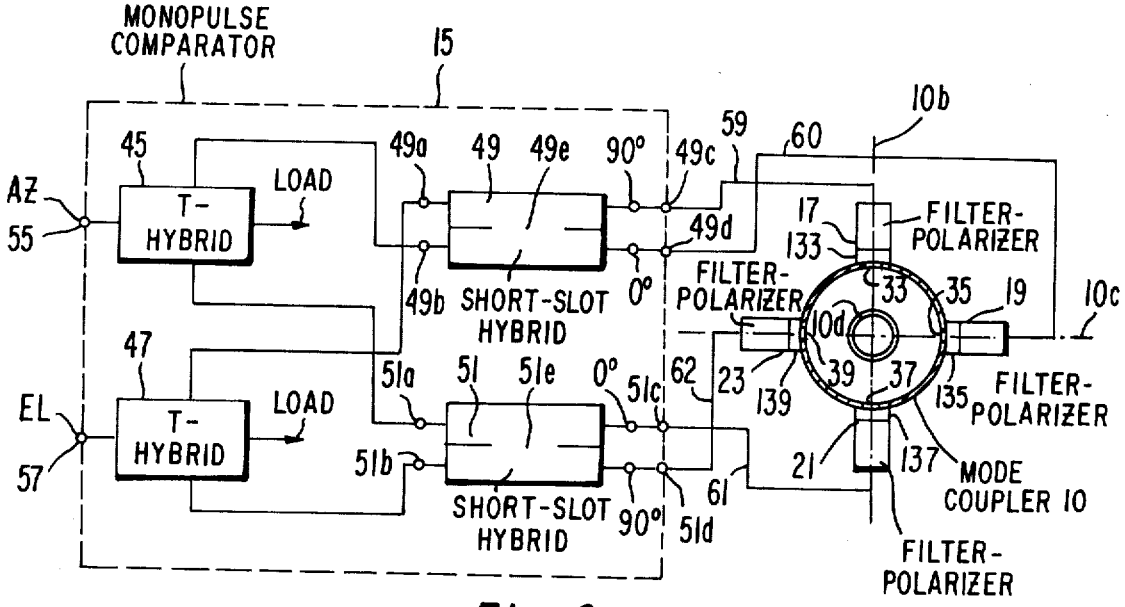
Figure 3:
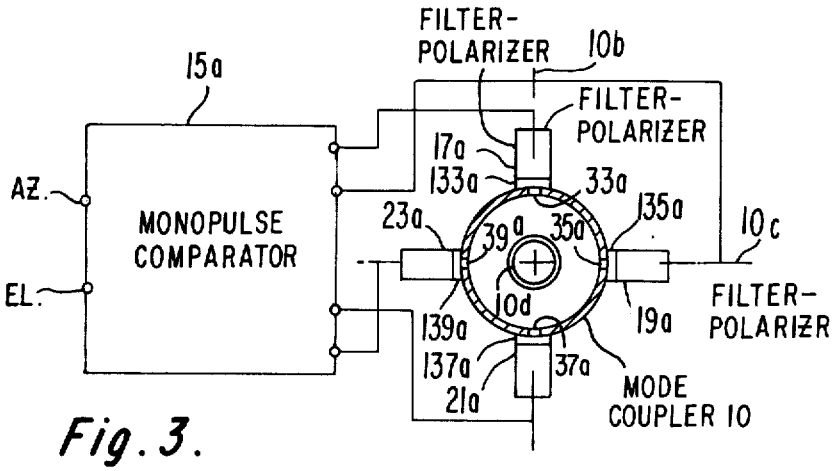

Referring to FIG. 1 and 2, a multimode coupler 10 and associated circuitry is illustrated. FIG. 1 shows a side view of the coupler 10. FIG. 2 illustrates an end cross-sectional view of the multimode monopulse coupler taken across lines 2 — 2 in FIG. 1 and a block diagram of the associated circuitry coupled to the apertures at the cross-section. The coupler 10 is generally a funnel-shaped hollow member 10 having orthogonal symmetrical planes along lines **10*b* and 10*c* of FIG. 2. This coupler 10 is a funnel-shaped hollow member in the form of a generally hollow truncated cone. The taper near the small aperture end 10*d* is greater and this end 10*d* is dimensioned and arranged so that transmitted signal waves in the dominant symmetrical $TE_{11}$ waveguide mode pass with low reflection and attenuation through the small aperture end 10*d* and exit at the large aperture end 10*e*. Reciprocal signal flow occurs for receive operations for waves at the wider end 10*e* of the funnel-shaped coupler 10. Asymmetrical or difference mode waves at a first frequency band of, for example, 3700 ± 7.5 MHz are coupled through the side wall coupling apertures 33, 35, 37 and 39 in the funnel-shaped coupler 10 with apertures 33 and 37 in plane 10*b* and apertures 35 and 39 in plane 10*c*. See FIG. 2. The asymmetrical waveguide modes are, for example, the $TE_{21} + TM_{01}$ modes and the $TE_{12}$ mode in circular waveguide. The cross-sectional dimension of the coupler at the center of the side wall apertures is made so as to support the $TE_{12}$ mode, $TE_{21} + TM_{01}$ modes in circular waveguide at 3700 MHz. Asymmetrical or difference circular waveguide mode waves at a second frequency band for instance at 4200 ± 7.5 MHz are coupled through the side wall coupling apertures 33*a*, 35*a*, 37*a* and 39*a* into the funnel-shaped coupler 10**. See FIG. 3. The same asymmetrical waveguide modes in circular waveguide are utilized as at the first frequency band.

Figure 4:
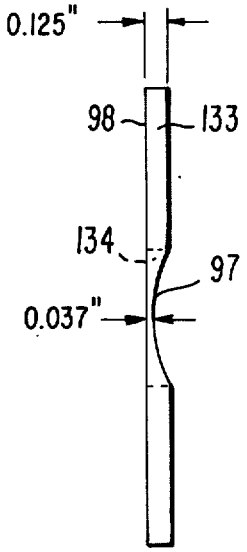

The sidewall coupling apertures **33, 35, 37, 39, 33*a*, 35*a*, 37*a*, and 39*a* are for example square apertures. A filter-polarizer for the first frequency band (17, 19, 21 or 23) is coupled at one end to one of the coupling apertures 33, 35, 37 and 39. Similarly, filter-polarizers for the second frequency band (17*a*, 19*a*, 21*a*, or 23*a* ) is coupled at one end to one of the coupling apertures 33*a*, 35*a*, 37*a* or 39*a*. The coupling slot 33 is coupled to filter-polarizer 17 via a coupling plate 133. The coupling plate 133 as illustrated in FIG. 4 is relatively thin (0.125 inches thick for example) and has a curved portion 97 on one side to match the inside curvature of the mode coupler 10 and a flat side 98 to match an end flange of filter-polarizer 17. The plate 133 has an aperture 134 therein dimensioned and when mounted aligned to match the aperture 33 in the mode coupler. Similarly, coupling slot 33*a* is coupled to the filter-polarizer 17*a* via plate 133*a* where plate 133*a* is similar to plate 133 including an aperture but with the curved portion to match the mode coupler at the distance $d_2$ from the end 10*d*. Similarly, coupling slot 135 is coupled to filter-polarizer 19 via plate 135 and coupling slot 35*a* is coupled to filter-polarizer 19*a* via plate 135*a*. Coupling slot 37 is coupled to filter-polarizer 21 via plate 137 and coupling slot 37*a* is coupled to filter-polarizer 21*a* via plate 137*a*. Coupling slot 39 is coupled to filter-polarizer 23 via plate 139 and coupling slot 39*a* is coupled to filter-polarizer 23*a* via plate 139*a*. Each of the plates 135, 135*a*, 137*a*, 139 and 139*a* are similar to plate 133** with one side adapted to match the mode coupler at the side wall aperture region and a flat side to match filter-polarizer on the opposite side. Each of the coupling plates has an aperture dimensioned and arranged to match the apertures in the mode coupler.

Figure 7:
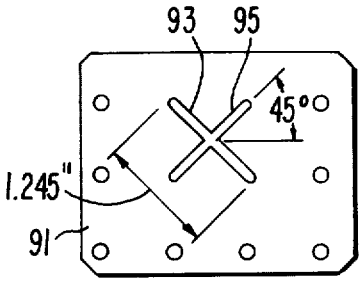
Figure 5:
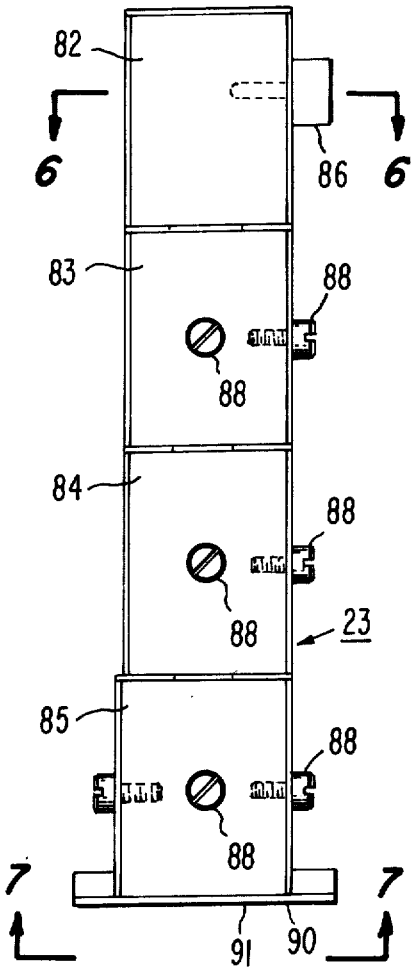
Figure 6:
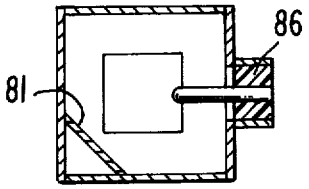

Each of the filter-polarizers **17, 17*a*, 19, 19*a*, 21, 21*a*, 23 and 23*a* comprises a plate with crossed slots therein at the end terminated with the coupling plates. Referring to FIGS. 5 thru 7, there is illustrated for example the filter-polarizer 23. The filter-polarizer 23 is a section of substantially square waveguide capable of supporting two orthogonal $TE_{10}$ modes. The filter-polarizer 23 is a four section waveguide filter with the four sections 82 thru 85 dimensioned to pass signals with a desired bandpass characteristic at a center frequency of 3700 MHz. The section 82 is coupled to the monopulse comparator circuitry 15 via coaxial line 62. A diagonal plate 81 in section 82 opposite to a coaxial-to-waveguide transition at coupling port 86 causes two orthogonal $TE_{10}$ mode signals from an input signal. The coaxial-to-waveguide transition is achieved by an extension of the center conductor into the waveguide aperture as shown. The other filter-polarizers each have a similar transition section. The filter-polarizers 17, 19, 21 and 23 are adapted to propagate two orthogonal $TE_{10}$ mode signals in the frequency band centered at 3700 MHz and the filter-polarizers 17*a*, 19*a*, 21*a* and 23*a* are adapted to propagate two orthogonal $TE_{10}$ mode signals at 4200 MHz. Each filter-polarizer acts to signals at frequencies outside the passband of the filter-polarizers propagating in the coupler 10 as a short circuit placed directly on top of the crossed slot and thus the communication signals outside the beacon frequencies remain unaffected by the side wall crossed slots or coupling apertures. The filter-polarizer 23, for example, has orthogonally extending tunable probes 88 penetrating through the walls of the waveguide. These probes 88 are adjusted in and out to set the relative magnitude and phase of the two orthogonal $TE_{10}$ mode signals. In this embodiment, a four section filter was utilized with the length of each section 82 thru 85 being slightly above a one-half wave length long and approximately equal. The end 90 of filter 23 is terminated by plate 91 which has equal length and orthogonal slots 93 and 95. An extension of plate 91 forms the flange to be connected to the coupling plate. These crossed-slots 93 and 95 are shown by dashed lines in FIG. 1. Each of these slots 93 and 95 make an angle of about 45° with the axis of the mode coupler 10. Each of the filter-polarizers 17, 19, and 21 are like polarizer 23 in FIGS. 5 thru 7. Similarly, filter-polarizers 17***a*, 21*a*, 19*a* and 23*a* are similar to filter-polarizer 23 but with these filters dimensioned to pass signals at 4200 MHz with a desired bandpass characteristic. Similarly, crossed slots 71*a* and 72*a* shown by dashed lines in FIG. 1 in the end of filter 23*a* are of equal length with these slots orthogonal to the other end at 45° with the axis of the mode coupler 10.

In applicant's arrangement described in U.S. Pat. No. 3,936,838, the coupling slots are located at a given distance along the axis of the mode coupler from the small aperture end 10*d*. This given distance was a specific length, namely, approximately one-half of the guide wavelength at the $TE_{21}$ asymmetrical mode or multiple thereof at the desired frequencies for difference mode operation. It has been found that this distance along the axis of the coupler can be other than that described above by exciting via adjustment of the filter-polarizer to produce in the transmit direction an elliptically polarized wave of a given ellipticity (axial ratio and polarization ellipse orientation). This ellipticity is produced by adjusting the orthogonal probes in the filter-polarizer to adjust the relative power in the two orthogonal modes such that the coupling slots are causing a desired elliptical polarization, which in turn causes another desired polarization at the large aperture end of the coupler 10. For example, a circular polarized asymmetrical mode at 3700 MHz provided with the distance $d_1$ from the narrow end 10*d* to the plane through the center of the sidewall apertures 33, 35, 37 and 39 in FIG. 1 is about 1.5 free space wavelengths and with the axial ratio of the elliptically polarized signal is adjusted by the tuning screws or probes in the filter-polarizers 17, 19, 21 and 23 to be 4 db with the major axis of the ellipse being 45° (counter clockwise) (arrow 40) as viewed from the transmission end of the filter (relative to the axis of the horn). In guide wavelengths, this distance $d_1$ for the $TE_{21}$ asymmetrical circular waveguide mode is approximately 1.26 guide wavelengths.

For the 4200 MHz case, for example, the distance $d_2$ from the narrow end 10*d* to the plane of the center of apertures 33*a*, 35*a*, 37*a* and 39*a* is approximately one free space wavelength with orthogonal tuning probes in the filter-polarizer 17*a*, 19*a*, 21*a* and 23*a* adjusted to provide an ellipticity with an axial ratio being 3 db with the major axis of the polarization ellipse in the direction of the axis of the coupler (arrow 41). For intermediate frequencies, the value of the distances, axial ratio, and polarization ellipse can be interpolated by those who have general knowledge in the art of waveguide circuits since these values vary slowly with frequency.

By adjustment of the tuning probes in the filter-polarizers any selected axial ratio may be obtained. To achieve circular polarization, the magnitude and phase of the elliptically polarized signal at the output of the filter-polarizers is adjusted such that in the plane of addition (in the plane of the large aperture end) the major axes of the wave directly traveling from the slot toward the large aperture end of the coupler and the wave reaching the large aperture end of the coupler via reflection from the small aperture end of the coupler are orthogonal in space and quadrature in phase. The above examples deal with right circular polarization (RCP). Left circular polarization can be obtained if the input coaxial-to-waveguide transition is inserted on an adjacent side wall of the filter-polarizer. Linear polarization may be achieved with given ellipticity of the wave at the end of the filter-polarizer and selected placement of the side wall coupling apertures from the small aperture end 10*d* of coupler 10.

The appropriate ellipticity for the required operations can be achieved by a test set up wherein a filter-polarizer is spaced 6 to 8 inches from a probe antenna. Signals are applied to the coaxial-to-waveguide transition of the filter-polarizer which radiates the generated elliptically polarized wave via its coupling aperture toward the pick-up probe. The polarization of the linearly polarized pick-up probe is rotatable by the use of a rotary joint. The output from the pick-up probe is coupled via a rotary joint to a detector. The orientation of the pick-up antenna is rotated to determine the plane which provides maximum and minimum received signal from which the axial ratio and orientation of polarization ellipse can be determined.

The processing of the asymmetrical waveguide mode waves involves the use of a monopulse comparator 15 and 15*a* and the coupling apertures in the coupler 10. Since identical processing takes place in the 4200 MHz frequency band system and the 3700 MHz frequency band system, only the 3700 MHz frequency band system is described herein with the other system being identical therewith.

The slots 33, 35, 37 and 39 are represented in FIG. 2 by a gap in the outline of coupler 10. The slots 33 and 37 are at diametrically opposite surfaces of the funnel-shaped hollow coupler 10 and in one plane 10*b* (indicated by long and short dashed lines) and are associated with the coupling of first asymmetrical waveguide mode signal waves. The slots 35 and 39 are at diametrically opposite surfaces of the funnel-shaped coupler 10 in a plane 10*c* (indicated by long and short dashed lines) orthogonal to the plane of slots 33 and 37 and are associated with the coupling of second orthogonal asymmetrical waveguide mode waves. By the operation of the monopulse comparator circuitry 15, slots 33 and 37 are excited approximately 90° out of phase with each other and slots 35 and 39 are excited 90° out of phase with each other. The monopulse comparator 15 consists of two magic tee hybrids (0° hybrids) 45 and 47 and two short slot hybrids (90° hybrids) 49 and 51 and connections therebetween. One of the magic tee hybrids 45 is coupled at one end to asymmetric terminal 55 of the comparator 15 and at the opposite end to terminal 49*b* of short-slot hybrid 49 and terminal 51*a* of short-slot hybrid 51. The other magic tee hybrid 47 is coupled at one end to the asymmetric terminal 57 of the monopulse coupler comparator 15 and at the opposite end to terminal 49*a* of short-slot hybrid 49 and terminal 51*b* of short-slot hybrid 51. The terminals 49*c*, 49*d*, 51*c* and 51*d* of short-slot hybrids 49 and 51 form the output terminals of the monopulse comparator 15.

The terminals 49*c*, 49 *c*, 51*c* and 51*d* of the comparator are coupled via coaxial transmission lines 59, 60, 61 and 62 to the respective bandpass filters 17, 19, 21 and 23, there being a coaxial-to-waveguide transition section between each of the terminals 49*c*, 49*d*, 51*c* and 51*d* of the comparator and the associated coaxial line.

In considering the transmit case, the azimuth tracking signals at terminal 55 are equally power divided at hybrid 45 and are coupled in phase to terminal 49*b* of hybrid 49 and terminal 51*a* of hybrid 51. The signal at terminal 49*b* is equally power divided with the output coupled to coupling slot 33 via terminal 49*c* undergoing 90° more phase shift than the signal coupled to slot 35. This additional phase shift is due to the coupling of the wave through the short slot 49*e* of hybrid 49. The azimuth tracking signals at terminals 51*a* are equally power divided with the output coupled to coupler slot 39 undergoing 90° more phase shift than the signals coupled to slot 37. With this phase and amplitude distribution, the signal at the coupling slots 33 and 39 is undergoing 90° more phase shift than the signals at slots 35 and 37 as indicated in FIG. 2.

The elevation tracking signals at terminal 57 are equally power divided at hybrid 47, and are coupled in phase to terminal 49*a* of hybrid 49 and terminal 51*b* of hybrid 41. The signal at terminal 49*a* is equally power divided with the output signal coupled to coupling slot 35 undergoing 90° more phase shift than the signal coupled to slot 33. The signal at terminal 51*b* is equally power divided with the signal at slot 37 undergoing 90° more phase shift than the signals coupled to slot 39. This results with the phase of the elevation tracking signals at slots 35 and 37 undergoing 90° more phase shift than the signals at slots 33 and 39.

With the arrangement shown in FIG. 2 and with all of the crossed coupling slots arranged as discussed previously, a right circularly polarized wave signal is associated with transmitter signals at the terminals 55 and 57 with azimuth tracking difference signals at terminal 55 and with elevation tracking difference signals at the other terminal 57. The azimuth difference mode information is associated with a circularly polarized wave made up of the combination of a vertically oriented and horizontally oriented $TE_{12}$ mode and the elevation information is associated with a circularly polarized wave made up of the hybrid mode of $TE_{21} + TM_{01}$ modes. Although, for convenience, the above description discusses the antenna system on a transmit basis, reciprocal operation takes place for received signals according to the well known reciprocity theory of antennas.

For operation over the previously described communications and tracking frequencies the coupler 10 has by way of example the following dimensions:

opening at end 10*e* = 5.44 inches Dia.
opening at end 10*d* = 2.12 inches Dia.
opening at 10*f* = 3.167 inches Dia.
axial length = 7.25 inches
distance *d*1 = 4.77 inches
distance *d*2 = 2.9 inches The filter-polarizer for 3700 GHz by way of example is three sections of 1.84 inches square waveguide (inside dimension) and one section 85 of 1.9 inches square (inside dimension) with the transition section (section furthest from mode coupler 10) the adjacent section and the section nearest the mode coupler 10 being 2.5 inches long, and the remaining section being 2.6 inches long. The crossed slots were each 1.245 inches long and 0.1 inch wide. In the transition section, the diagonal fin is 0.87 inch wide extending between an adjacent and opposite wall from the coupling wall. The coupling irises had the following dimensions — between sections 82 and 83 — 0.925 inch square centered, between sections 83 and 84 — 0.6 inch square and between sections 84 and 85 — 0.5 inch square. All irises were centered.

The 4200 MHz filter-polarizer was also a four section filter with the waveguide cross section being about 1.6 inches by 1.54 inches. The length of the sections varied from 2.5 inches of the transition section to 2.75 inches at the end adjacent to the coupling member. The coupling slots are 1.17 inches long and 0.100 inch wide. The coupling irises had the following dimensions: between 82 and 83 — 0.925 inch square between sections 83 and 84 — 0.6 inch square, and between sections 84 and 85 — 0.6 inch square. All irises were centered.

What is claimed is:

1. A multimode coupling system for coupling symmetrical waveguide mode signals at one frequency band and asymmetrical waveguide mode signals at another frequency band comprising:

a generally funnel-shaped hollow coupler with the small aperture end adapted to pass said symmetrical mode signals and reflect asymmetrical mode signals and the large aperture end adapted to be coupled to free space, an asymmetrical mode signal terminal, first and second sidewall coupling apertures in the tapering side wall of said coupler with said first and second side wall coupling apertures at diametrically opposite surfaces of said coupler and in a given plane orthogonal to the axis of the coupler a given distance from the small aperture end of said coupler, third and fourth side wall coupling apertures in the tapering side wall of said coupler with said third and fourth side wall coupling apertures at diametrically opposite surfaces of said coupler equally spaced from said first and second side wall apertures and in said first given plane at said first given distance from the small aperture end of said coupler, and coupling means including a filter-polarizer coupled between each of said first, second, third and fourth sidewall apertures and said asymmetrical mode signal terminal characterized by a response to signals at said terminal for coupling equal portions of the signal energy at the terminal to said first, second, third and fourth apertures with the phase of the coupled signals at the first and third apertures being advanced 90° relative to the phase of the signals at the second and fourth apertures, said filter-polarizers characterized by a response to signals applied thereto at the terminal end thereof for exciting an elliptical polarized wave into the coupler, said given distance from said small aperture end of said coupler being selected together with the elliptical polarization characteristic of the filters to achieve a maximum coupling of asymmetric waveguide mode signal at a wanted polarization different from said elliptically polarized wave excited by the filter-polarizers.

2. The combination claimed in claim 1 wherein said wanted polarization is circular polarization and said given distance is such that the major axis of the excited elliptically-polarized waves and the major axis of the elliptically polarized wave reflected from the small aperture end at large aperture end is orthogonal in space and quadrature in phase.

3. The combination of claim 1 wherein said filter-polarizers are each square waveguide sections adapted to propagate signals in two orthogonal $TE_{10}$ modes with means for exciting and adjusting the relative magnitudes of two orthogonal $TE_{10}$ modes.

4. The combination of claim 1 wherein said filter-polarizer includes a crossed-slot aperture.

5. A multimode coupling system for coupling symmetrical waveguide mode signals at one frequency band and asymmetrical waveguide mode signals at a second and third frequency band comprising:

a generally funnel-shaped hollow coupler with the small aperture end adapted to pass signals in said symmetrical mode and reflect said signals in said asymmetrical mode and a large aperture end adapted to be coupled to free space, first and second asymmetrical mode signal terminals, a first set of four sidewall coupling apertures in the tapering sidewall of said coupler with said first set of sidewall apertures equally spaced from each other and in a first plane orthogonal to the axis of the coupler with said plane a first given distance from the small aperture end of said coupler, a second set of four sidewall coupling apertures in the tapering sidewall of said coupler with said second set of sidewall coupling apertures equally spaced from each other in a second plane orthogonal to the axis of the coupler with said second plane a second given distance from the small aperture end of said coupler, means including a first filter-polarizer adapted to pass signals at said second frequency band coupled between each of said first set of sidewall apertures and the first of said asymmetrical mode signal terminals characterized by a response to signals at said second frequency band at said first terminal to excite first elliptically polarized waves at said second frequency in said coupler, and means including a second filter-polarizer adapted to pass signals at said third frequency band coupled between each of said second set of sidewall apertures and the second of said asymmetrical mode terminals characterized by a response to signals at said third frequency band at said second terminal to excite second elliptically polarized waves at said third frequency in said coupler.

6. The combination of claim 5 wherein said first and second given distances are unequal.

7. The combination of claim 5 wherein said first given distance is selected to achieve maximum coupling of asymmetrical waveguide mode signals at said second frequency band at a wanted polarization different from said first elliptically polarized waves and said second given distance is selected to achieve maximum coupling of an asymmetrical waveguide mode signals at said third frequency band at a wanted polarization different from said second elliptically polarized wave.

8. The combination of claim 7 wherein said wanted polarization is circular polarization.

* * * * *